US009992846B2

(12) United States Patent
Wei et al.

(10) Patent No.: US 9,992,846 B2
(45) Date of Patent: Jun. 5, 2018

(54) ACTIVE DAMPING CIRCUIT

(71) Applicant: OSRAM SYLVANIA Inc., Wilmington, MA (US)

(72) Inventors: Jinsheng Wei, Brea, CA (US); Andrew Johnsen, Danvers, MA (US); Ranjit Jayabalan, Boxborough, MA (US); Nitin Kumar, Bavaria (DE)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days. days.

(21) Appl. No.: 15/552,232

(22) PCT Filed: Feb. 25, 2016

(86) PCT No.: PCT/US2016/019656

§ 371 (c)(1),
(2) Date: Aug. 18, 2017

(87) PCT Pub. No.: WO2016/138319

PCT Pub. Date: Sep. 1, 2016

(65) Prior Publication Data

US 2018/0042084 A1 Feb. 8, 2018

Related U.S. Application Data

(60) Provisional application No. 62/120,646, filed on Feb. 25, 2015.

(51) Int. Cl.
*H05B 37/02* (2006.01)

(52) U.S. Cl.
CPC ..... *H05B 37/0209* (2013.01)

(58) Field of Classification Search
CPC ..... H05B 33/0815; H05B 33/0851; H05B 33/0887; H05B 33/089; H05B 37/02;
(Continued)

(56) References Cited

U.S. PATENT DOCUMENTS 8,264,165 B2 * 9/2012 Gu ..... H05B 33/0815 315/209 R
8,847,498 B2 * 9/2014 Chen ..... H05B 33/0809 315/125

(Continued)

FOREIGN PATENT DOCUMENTS

EP 2 696 486 A2 2/2014
WO 2012/007797 A1 1/2012

(Continued)

OTHER PUBLICATIONS

Wei et al., U.S. Appl. No. 15/552,241, "Active Damping Circuit", filed Aug. 18, 2017.*

(Continued)

*Primary Examiner* — Haissa Philogene
(74) *Attorney, Agent, or Firm* — Shaun P. Montana

(57) ABSTRACT

An active damping circuit and system including the same are disclosed. The active damping circuit includes a first resistor, a second resistor, a third resistor, a first transistor, a second transistor, a capacitor, and a microcontroller. The first resistor is connected to a base of the first transistor, and to the microcontroller output. The second resistor is connected to a positive voltage, and to a collector of the first transistor and a gate of the second transistor. The third resistor is connected to a logic ground, and to a source of the second transistor. The capacitor is connected to the collector of the first transistor, the second resistor, and the gate of the second transistor. A drain of the second transistor, and the first capacitor, and the second capacitor, and the microcontroller output, are also connected to the logic ground. An emitter of the first transistor is connected to ground.

16 Claims, 2 Drawing Sheets

(58) Field of Classification Search
CPC .... H05B 37/0209; H02M 7/125; H02M 1/44; H02M 2001/0045
See application file for complete search history.

(56) References Cited

U.S. PATENT DOCUMENTS

| | | | | |
|---|---|---|---|---|
| 9,332,613 | B2 * | 5/2016 | Pregitzer | H05B 33/089 |
| 2012/0026761 | A1 | 2/2012 | Young | |
| 2013/0307417 | A1 | 11/2013 | Chen et al. | |
| 2014/0084801 | A1 | 3/2014 | Lys | |
| 2014/0203721 | A1 * | 7/2014 | Qiao | H05B 33/0815 315/201 |
| 2014/0300289 | A1 | 10/2014 | Zhu | |

FOREIGN PATENT DOCUMENTS

| | | | |
|---|---|---|---|
| WO | 2012/016197 | A1 | 2/2012 |
| WO | 2013/072111 | A1 | 5/2013 |

OTHER PUBLICATIONS

Muller, Uta, International Search Report and Written Opinion of the International Searching Authority for PCT/US2016/019656, dated May 6, 2016, pp. 1-12, European Patent Office, Rijswijk, the Netherlands.
Muller, Uta, International Search Report and Written Opinion of the International Searching Authority for PCT/US2016/019659, dated May 6, 2016, pp. 1-12, European Patent Office, Rijswijk, the Netherlands.

* cited by examiner

ACTIVE DAMPING CIRCUIT

CROSS-REFERENCE TO RELATED APPLICATIONS

The present application is an intcrnational a National Stage application of, and claims the benefit of priority of, International Application No. PCT/US2016/019656, which claims priority of United States Provisional Application No. 62/120,646,entitled "ACTIVE DAMPING CIRCUITS" and filed Feb. 25, 2015, the entire contents of which are hereby incorporated by reference.

The present application is related to PCT Application No. PCT/US2016/019659entitled "ACTIVE DAMPING CIRCUIT", and filed on Feb. 25, 2016, the entire contents of which are hereby incorporated by reference.

TECHNICAL FIELD

The present invention relates to electronics, and more specifically, to active damping circuits.

BACKGROUND

Traditional light sources are typically dimmed using a phase cut dimmer, which includes or is based on a Triode for Alternating Current (TRIAC), for example. Traditional TRIAC-based phase cut dimmers do not function well with solid state light sources. In order to function, a solid state light source typically needs a driver (also referred to as a power supply). These typically include components to decrease electromagnetic interference (EMI), such as inductors or capacitors. Such components can create resonance that disrupts the operation of a traditional TRIAC-based phase cut dimmer. A phase cut or TRIAC-based dimmer requires a minimum holding current after being triggered. If the current drops below this level, or becomes negative for a certain time, the TRIAC dimmer will be turned off and would try to restart. The resonant nature of a typical input EMI filter on a driver, as well as line inductance, can easily lead to the reversal of line current, causing the TRIAC to lose conduction shortly after triggering. This may result in the TRIAC turning on and turning off, repeatedly, during each half line period, introducing flickering into the solid state light source(s) operated by the driver.

SUMMARY

To address flickering potentially introduced by using a conventional TRIAC or phase cut dimmer with a driver for solid state light sources, a damping circuit (also referred to as a damper circuit) is typically used. The damping circuit is inserted between the dimmer and the driver, or integrated into the driver's front EMI filter. The damping circuit then damps the input current to the driver, preventing it from becoming negative. Damping circuits may be passive or active. Passive damping circuits typically include Resistor Capacitor (RC) or Resistor Capacitor Diode (RCD) circuits, which produce higher power losses because they receive power even when the turn-on of the dimmer is complete. Active damping circuits only operate when needed during the turn-on short period of the dimmer.

Conventional active damping circuits, particularly for lighting loads, may offer low costs due to low numbers of components, but suffer from a variety of other deficiencies. For example, such conventional damping circuits frequently have a high power loss, and separate the control logic from the MOSFET's gate-source voltage control logic by line voltage. Such conventional damping circuits also require two line voltage resistor dividers, due to the grounds present in the circuit. Further, conventional active damping circuits generally insert a resistor and a capacitor, temporarily, into a main power circuit and combine with the driver's EMI filter's inductance or line inductance to form a Resistor Inductor Capacitor (RLC) circuit. Adapting the value of the resistor can damp the resonance of the LC portion of the circuit. However, when an input voltage is high, the resonance is likely higher, which means that the chosen damping resistor may work for low input voltages but not high input voltages. This is particularly true for drivers that operate on a so-called universal input voltage of either 120 volts or 277 volts.

Embodiments provide an active damping circuit driven by a microcontroller. Such embodiments require only a single logic ground, which is easy to implement with the microcontroller, along with low total harmonic distortion, no input current distortion, and improved efficiency, among other things In an embodiment, there is provided an active damping circuit. The active damping circuit includes: a first resistor including a first lead and a second lead; a second resistor including a first lead and a second lead, wherein the first lead is connected to a positive voltage; a third resistor including a first lead and a second lead, wherein the first lead is connected to a logic ground; a first transistor including a base, an emitter, and a collector, wherein the base is connected to the first lead of the first resistor, the emitter is connected to a ground, and the collector is connected to the second lead of the second resistor; a second transistor including a gate, a source, and a drain, wherein the gate is connected to the second lead of the second resistor and the collector of the first transistor, the source is connected to the second lead of the third resistor, and the drain is connected to the logic ground; a first capacitor including a first lead and a second lead, wherein the first lead is connected to the collector of the first transistor, the second lead of the second resistor, and the gate of the second transistor, and the second lead is connected to the logic ground; and a microcontroller including an output connected to the second lead of the first resistor, and a connection to the logic ground.

In a related embodiment, the active damping circuit may further include a first input connected to the source of the second transistor and to the second lead of the third resistor. In a further related embodiment, the first input may receive an input signal that has been filtered by a filter circuit. In a further related embodiment, the input signal, prior to being filtered, may pass through a phase cut dimmer circuit. In a further related embodiment, the active damping circuit may further include a control input that is coupled to the output of the microcontroller and to the second lead of the first resistor.

In a further related embodiment, the microcontroller may be configured to detect a phase of the input signal prior to being filtered, and in response, may be configured to output a high level via the control input to the first resistor to turn off the second transistor, which couples the third resistor to an input voltage loop with the first capacitor, damping rings of an input current into the negative to prevent the phase cut dimmer circuit being turned off.

In another further related embodiment, a turn off period for the second transistor may be controlled according to a detected phase status of the input signal.

In another related embodiment, the active damping circuit may be configured to operate with an input voltage of either 120 volts or 277 volts.

In another embodiment, there is provided a system. The system includes: an input voltage source; a dimmer circuit connected to the input voltage source and configured to output a phase cut signal; a bridge configured to receive the phase cut signal and to provide an output; an electromagnetic filter connected to the bridge and configured to receive the output of the bridge and to filter the output of the bridge; and an active damping circuit connected the electromagnetic filter, the active damping circuit including: a first resistor including a first lead and a second lead; a second resistor including a first lead and a second lead, wherein the first lead is connected to a positive voltage; a third resistor including a first lead and a second lead, wherein the first lead is connected to a logic ground; a first transistor including a base, an emitter, and a collector, wherein the base is connected to the first lead of the first resistor, the emitter is connected to a ground, and the collector is connected to the second lead of the second resistor; a second transistor including a gate, a source, and a drain, wherein the gate is connected to the second lead of the second resistor and the collector of the first transistor, the source is connected to the second lead of the third resistor, and the drain is connected to the logic ground; a first capacitor including a first lead and a second lead, wherein the first lead is connected to the collector of the first transistor, the second lead of the second resistor, and the gate of the second transistor, and the second lead is connected to the logic ground; and a microcontroller including an output connected to the second lead of the first resistor and a connection to the logic ground.

In a related embodiment, the electromagnetic filter may include a filter capacitor including a first lead and a second lead, the first lead may be connected to the second lead of the third resistor and the source of the second transistor. In a further related embodiment, the system may further include a Direct Current (DC) to DC converter, the DC to DC converter including a first input connected to the second lead of the filter capacitor, a second input connected to the logic ground, and an output, the DC to DC converter may be configured to provide a DC voltage at the output. In a further related embodiment, the electromagnetic filter may further include a filter inductor including a first lead and a second lead, the first lead may be connected to the first input of the DC to DC converter and the second lead of the filter capacitor. In a further related embodiment, the dimmer circuit may include a phase cut dimmer circuit connected to the input voltage source. In a further related embodiment, the microcontroller may be configured to detect a phase of the output of the bridge, and in response, the microcontroller may be configured to output a high level to the first resistor to turn off the second transistor, which couples the third resistor to an input voltage loop with the first capacitor, damping rings of an input current into the negative to prevent the phase cut dimmer circuit being turned off. In a further related embodiment, a turn off period for the second transistor may be controlled according to a detected phase status of the output of the bridge.

In another related embodiment, the active damping circuit may be configured to operate with an input voltage of the input voltage source being either 120 volts or 277 volts

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
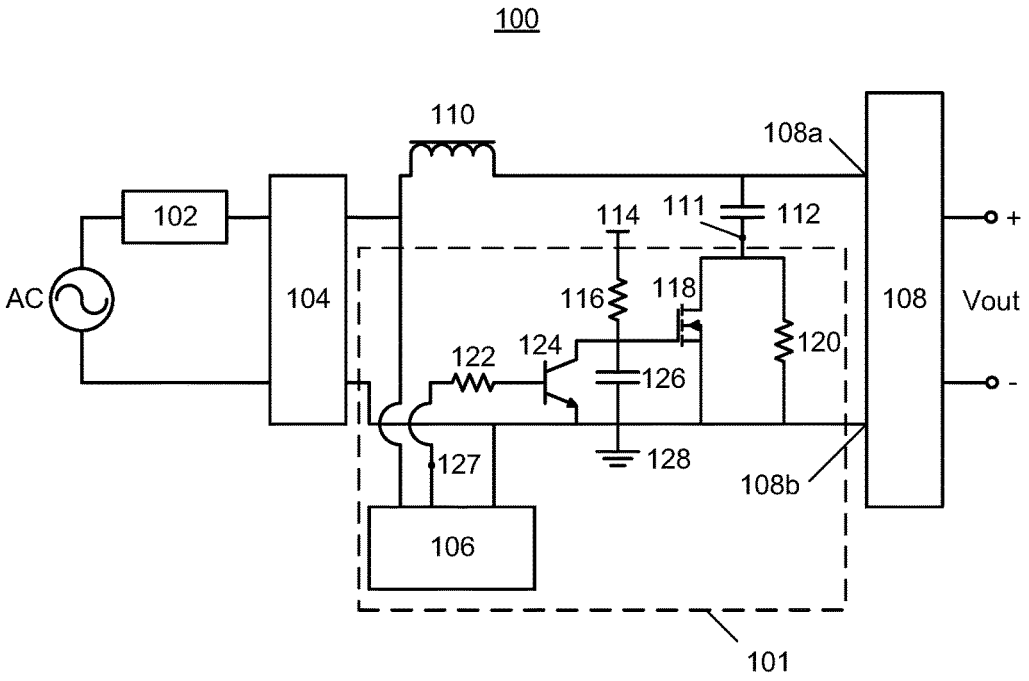
FIG. 1 shows a microprocessor driven active damping circuit according to embodiments disclosed herein.

FIG. 1 shows a system 100 including an active damping circuit 101 that is low cost with a low component count. The active damping circuit 101 is driven by a microcontroller 106, which is used to predict edges of a phase cut signal. Such a phase cut signal results from, for example, an output of an alternating current source AC passing though a TRIAC-based/phase-cut dimmer 102. The phase cut signal also passes through a bridge 104, which in some embodiments is a full diode bridge, and in some embodiments is a full wave rectifier, and in some embodiments is any known rectifier circuit.

The active damping circuit 101 includes a first resistor 122, a second resistor 116, a third resistor 120, a capacitor 126, a first transistor 124, and a second transistor 118, along with a microcontroller 106, which drives the active damping circuit 101, a ground 128, a control input 127, and an input 111. The system 100 also includes a filter circuit 110, 112, a VCC voltage 114, a DC-to-DC converter 108, and an output Vout. The DC-to-DC converter 108 has a first input 108*a* and a second input 108*b*.

The microcontroller 106 is connected to an output of the bridge 104, and thus receives the phase cut signal of the phase-cut dimmer 102. The microcontroller 106 is also connected to the first resistor 122, via the control input 127, and to the ground 128. In some embodiments, the ground 128 is a logic ground provided by the microcontroller 106. The first resistor 122 is also connected to a base of the first transistor 124. The first transistor 124 also includes an emitter, connected to the ground 128, and a collector. The collector of the first transistor 124 is connected to the capacitor 126, the second resistor 116, and to a gate of the second transistor 118. The capacitor 126 is also connected to the ground 128. The second resistor 116 is also connected to the VCC voltage 114. The second transistor 118 also includes a drain, which is connected to the ground 128, and a source, which is connected to the input 111. The input 111 is also connected to the third resistor 120, which is also connected to the ground 128.

The filter circuit 110, 112 may be, and in some embodiments is, any filter circuit known in the art. In FIG. 1, the filter circuit 110, 112 includes a filter inductor 110 and a filter capacitor 112. The filter inductor 110 is connected between the bridge 104 and the DC-to-DC converter 108, and more specifically, is connected to the first input 108*a* of the DC-to-DC converter 108. The filter capacitor is also connected to the first input 108*a* of the DC-to-DC converter 108, and to the input 111 of the active damping circuit 101. The second input 108*b* of the DC-to-DC converter 108 is connected to the ground 128. In some embodiments, as shown in FIG. 1, the microcontroller 106 is connected to the bridge 104 before the filter circuit 110, 112, and in FIG. 1 before the filter inductor 110. However, in other embodiments, the microcontroller 106 is connected to the input 111 and receives the phase cut signal after it has been filtered by the filter circuit 110, 112.

In operation, the third resistor 120 functions as a damping resistor 120, the second transistor 118 is a Metal Oxide Semiconductor Field Effect Transistor (MOSFET) switch 118, and the first transistor 124 is a Bipolar Junction Transistor (BJT) switch 124. The damping resistor 120 is coupled across the source and the drain of a MOSFET switch 118. The MOSFET switch 118 is driven such that it will be turned off by the BJT switch 124 in conjunction with the first resistor 122 and the capacitor 126. The capacitor 126 is connected between the gate of the MOSFET switch 118 and the ground 128. The collector of the BJT switch 124 is also connected to the gate of the MOSFET switch 118. The emitter of the BJT switch 124 is connected to the ground 128, and the base of the BJT switch 124 is connected to the first resistor 122, which is connected to the microcontroller 106 via the control input 127. The MOSFET switch 118 is driven such that it will be turned on by the second resistor 116, which is connected to the gate of MOSFET switch 118 and to the VCC voltage 114.

The microcontroller 106 uses an edge detection circuit (not shown here but known in the art) to detect the phase of the input signal output by the alternative current source AC after it passes through the phase-cut dimmer 102 (and the bridge 104). The microcontroller 106 outputs a high level to the first resistor 122 to turn off the MOSFET switch 118 via the BJT switch 124, which couples the damping resistor 120 to the input voltage loop with the filter circuit 110, 112, and specifically, the filter capacitor 112, damping the rings of the input current into the negative to prevent phase-cut dimmer 102 from being turned off. The turn off period for the MOSFET switch 118 is controlled according to the detected phase status of the input signal output by the alternative current source AC after it passes through the phase-cut dimmer 102 (and the bridge 104) along with, or in addition to, other related circuit operating situations.

Figure 2:
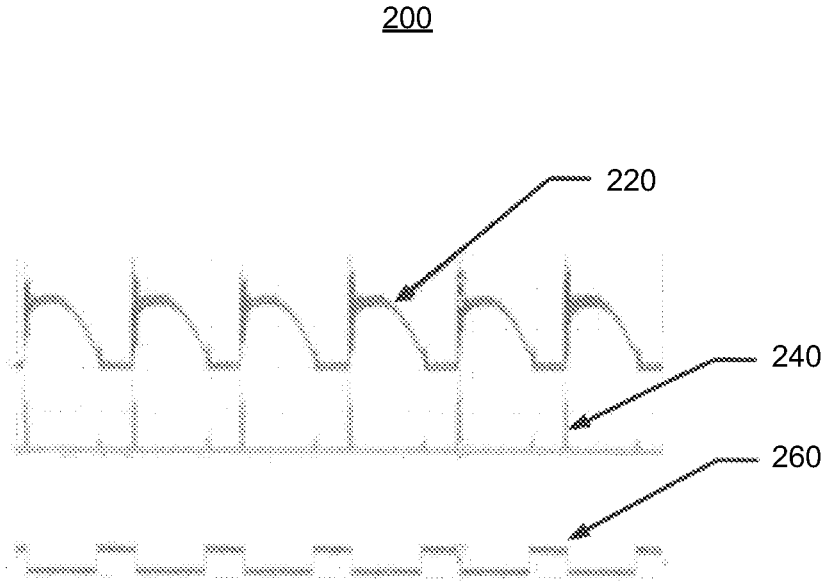
FIG. 2 shows a graph of a rectified line voltage, an "on" signal from a microcontroller, and a current through a damping resistor, according to embodiments disclosed herein.

FIG. 2 shows a graph 200 of the operation of an active damping circuit with a leading edge phase-cut dimmer, such as the active damping circuit 101 and the phase-cut dimmer 102 of FIG. 1. The graph 200 shows a rectified line voltage 220, such as but not limited to the output of the bridge 104 of FIG. 1. The graph 200 also shows a current through a damping resistor 240, such as but not limited to the third (damping) resistor 120 of FIG. 1, and an "on" signal from a microcontroller that effectively controls the damping resistor 260, such as but not limited to the microcontroller 106 of FIG. 1.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer(s), workstation(s) (e.g., Sun, HP), personal digital assistant(s) (PDA(s)), handheld device(s) such as cellular telephone(s) or smart cellphone(s), laptop(s), handheld computer(s), or another device(s) capable of being integrated with a processor(s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. An active damping circuit, comprising:

a first resistor comprising a first lead and a second lead;

a second resistor comprising a first lead and a second lead, wherein the first lead is connected to a positive voltage;

a third resistor comprising a first lead and a second lead, wherein the first lead is connected to a logic ground;

a first transistor comprising a base, an emitter, and a collector, wherein the base is connected to the first lead of the first resistor, the emitter is connected to the logic ground, and the collector is connected to the second lead of the second resistor;

a second transistor comprising a gate, a source, and a drain, wherein the gate is connected to the second lead of the second resistor and the collector of the first transistor, the source is connected to the second lead of the third resistor, and the drain is connected to the logic ground;

a first capacitor comprising a first lead and a second lead, wherein the first lead is connected to the collector of the first transistor, the second lead of the second resistor, and the gate of the second transistor, and the second lead is connected to the logic ground; and a microcontroller comprising an output connected to the second lead of the first resistor, and a connection to the logic ground.

2. The active damping circuit, further comprising a first input, wherein the first input is connected to the source of the second transistor and to the second lead of the third resistor.

3. The active damping circuit of claim 2, wherein the first input receives an input signal, wherein the input signal has been filtered by a filter circuit.

4. The active damping circuit of claim 3, wherein the input signal, prior to being filtered, passes through a phase cut dimmer circuit.

5. The active damping circuit of claim 4, further comprising a control input, wherein the control input is coupled to the output of the microcontroller and to the second lead of the first resistor.

6. The active damping circuit of claim 5, wherein the microcontroller is configured to detect a phase of the input signal prior to being filtered, and in response, is configured to output a high level via the control input to the first resistor to turn off the second transistor, which couples the third resistor to an input voltage loop with the first capacitor, damping rings of an input current into the negative to prevent the phase cut dimmer circuit being turned off.

7. The active damping circuit of claim 5, wherein a turn off period for the second transistor is controlled according to a detected phase status of the input signal.

8. The active damping circuit of claim 1, wherein the active damping circuit is configured to operate with an input voltage of either 120 volts or 277 volts.

9. A system, comprising:

an input voltage source;

a dimmer circuit connected to the input voltage source and configured to output a phase cut signal;

a bridge configured to receive the phase cut signal and to provide an output;

an electromagnetic filter connected to the bridge and configured to receive the output of the bridge and to filter the output of the bridge; and an active damping circuit connected the electromagnetic filter, the active damping circuit comprising:

a first resistor comprising a first lead and a second lead;

a second resistor comprising a first lead and a second lead, wherein the first lead is connected to a positive voltage;

a third resistor comprising a first lead and a second lead, wherein the first lead is connected to a logic ground;

a first transistor comprising a base, an emitter, and a collector, wherein the base is connected to the first lead of the first resistor, the emitter is connected to the logic ground, and the collector is connected to the second lead of the second resistor;

a second transistor comprising a gate, a source, and a drain, wherein the gate is connected to the second lead of the second resistor and the collector of the first transistor, the source is connected to the second lead of the third resistor, and the drain is connected to the logic ground;

a first capacitor comprising a first lead and a second lead, wherein the first lead is connected to the collector of the first transistor, the second lead of the second resistor, and the gate of the second transistor, and the second lead is connected to the logic ground; and a microcontroller comprising an output connected to the second lead of the first resistor and a connection to the logic ground.

10. The system of claim 9, wherein the electromagnetic filter comprises a filter capacitor comprising a first lead and a second lead, wherein the first lead is connected to the second lead of the third resistor and the source of the second transistor.

11. The system of claim 10, further comprising a Direct Current (DC) to DC converter, the DC to DC converter comprising a first input connected to the second lead of the filter capacitor, a second input connected to the logic ground, and an output, wherein the DC to DC converter is configured to provide a DC voltage at the output.

12. The system of claim 11, wherein the electromagnetic filter further comprises a filter inductor comprising a first lead and a second lead, wherein the first lead is connected to the first input of the DC to DC converter and the second lead of the filter capacitor.

13. The system of claim 12, wherein the dimmer circuit comprises a phase cut dimmer circuit connected to the input voltage source.

14. The system of claim 13, wherein the microcontroller is configured to detect a phase of the output of the bridge, and in response, the microcontroller is configured to output a high level to the first resistor to turn off the second transistor, which couples the third resistor to an input voltage loop with the first capacitor, damping rings of an input current into the negative to prevent the phase cut dimmer circuit being turned off.

15. The system of claim 14, wherein a turn off period for the second transistor is controlled according to a detected phase status of the output of the bridge.

16. The system of claim 9, wherein the active damping circuit is configured to operate with an input voltage of the input voltage source being either 120 volts or 277 volts.

* * * * *